US005421458A

United States Patent [19]

Campbell

[11] Patent Number: 5,421,458

[45] Date of Patent: Jun. 6, 1995

[54] CARTON FOR A PLURALITY OF ARTICLES AND BLANK THEREFOR

[75] Inventor: Geoffrey Campbell, Bristol, United Kingdom

[73] Assignee: Riverwood International Ltd., Bristol, United Kingdom

[21] Appl. No.: 298,369

[22] Filed: Aug. 30, 1994

Related U.S. Application Data

[63] Continuation of Ser. No. 39,267, Apr. 8, 1993, abandoned.

[30] Foreign Application Priority Data

Aug. 9, 1991 [GB] United Kingdom ..... 9117272

[51] Int. Cl.[6] ..... B65D 75/00

[52] U.S. Cl. ..... 206/434; 206/140; 206/427

[58] Field of Search ..... 206/434, 140, 427, 141; 229/40

[56] References Cited

U.S. PATENT DOCUMENTS

| | | | |
|---|---|---|---|
| 2,765,073 | 10/1956 | Murray | 206/434 |
| 3,014,636 | 12/1961 | Fielding | 206/434 |
| 3,306,519 | 2/1967 | Wood | 229/40 |
| 3,330,463 | 7/1967 | Wood . | |
| 3,339,723 | 9/1967 | Wood | 229/40 X |
| 3,348,672 | 10/1967 | Brown | 229/40 X |
| 3,429,496 | 2/1969 | Hickin | 206/140 X |
| 3,701,181 | 10/1972 | Lock | 229/40 X |
| 3,963,121 | 6/1976 | Kipp | 206/434 |
| 4,128,169 | 12/1978 | Arneson . | |
| 4,440,340 | 4/1984 | Bakx | 229/40 |
| 4,925,019 | 5/1990 | Ganz et al. | 229/40 X |
| 5,000,313 | 3/1991 | Oliff | 206/140 |

FOREIGN PATENT DOCUMENTS

| | | |
|---|---|---|
| 262744 | 2/1963 | Australia . |
| 436113 | 11/1967 | Australia . |
| 519074 | 11/1981 | Australia . |
| 603026 | 11/1988 | Australia . |
| 1083091 | 8/1980 | Canada . |
| 2409209 | 6/1979 | France . |
| 2846311 | 5/1979 | Germany . |
| 54-72195 | 6/1979 | Japan . |
| 63-44634 | 9/1988 | Japan . |
| 1505120 | 7/1989 | Japan . |
| 200997 | 6/1982 | New Zealand . |
| 2008074 | 5/1979 | United Kingdom . |

*Primary Examiner*—Bryon P. Gehman
*Attorney, Agent, or Firm*—Hopkins & Thomas

[57] ABSTRACT

A carton for containing a plurality of articles such as beverage cans, comprises top, bottom and side panels forming an open-ended sleeve. A short upper side panel connects each side panel to a corresponding edge of the top panel and the bottom panel extends between the lower edges of the side panels. A set of gussets are provided with each gusset being hingedly attached to the end of a side panel, hingedly attached to a corresponding end of the top panel, and separated from said upper side panel. A fold-line subdivides each gusset into a first portion and a second portion and the gusset is folded along the fold-line to position the second portion of the gusset against the side panel with the first portion of the gusset extending across a part of the open end of the sleeve for retaining articles in the carton.

3 Claims, 2 Drawing Sheets

CARTON FOR A PLURALITY OF ARTICLES AND BLANK THEREFOR

This is a continuation of application Ser. No. 08/039,267 filed on Apr. 8, 1993, now abandoned.

FIELD OF THE INVENTION

This invention relates to cartons and blanks therefor.

BACKGROUND OF THE INVENTION

Various cardboard sleeves for multipacks are known, but generally have apertures at the junction of the side and top panels for receiving the top edges of the articles. With certain articles, especially cans, the necessary aperture is located very close to the end edge of the sleeve and thus render the remaining strip of card vulnerable to tearing whenever the pack is handled. Tearing of course seriously affects the usefulness of the sleeve, but compactness of carton is essential not only from an aesthetic point of view but also from a business point of view. Clearly it is desirable to use as little cardboard as possible whilst retaining structural integrity and also bulkier cartons occupy more space and increase transport costs.

SUMMARY OF THE INVENTION

According to a first aspect of the present invention there is provided a carton for receiving a plurality of articles, which carton comprises a top portion, a bottom portion, two side portions, the side and/or bottom portions being provided with formations for engaging the heel portions of at least some of said articles, and gusset portions provided between the side portions and the top portion so as to extend across at least part of each end area of the carton.

Preferably two gusset portions are provided at each end of the carton between each side portion and each top portion. The formations for engaging the heel portions are in the form of apertures in each of which is received and retained a heel portion.

In a preferred embodiment each gusset portion comprises two panels, the first of which is hingedly connected to the top portion and the second of which is hingedly connected to the associated side portion, both panels being hingedly connected together such that one of said panels is bent towards its associated portion to allow the other panel to extend across the open end area of the carton.

It is a preferred feature that no further hinges are provided in said other panel of each gusset portion. Also said one panel of each gusset portion is held against its associated top or preferably side portion by one of said articles.

Preferably, the top portion is hingedly connected along opposite side edges to the side portions and each side portion is hingedly connected to a bottom panel, the two bottom panels being secured together to constitute said bottom portion.

In one arrangement the two bottom panels are formed with interengaging formations to effect their securing together. Alternatively, the two bottom panels could be adhesively secured together.

Convenienty the carton is adapted to receive two rows of articles so that two articles face each open end and the articles are retained in the carton by the gusseted portions and the heel engaging formations, one of which is provided for each article.

Ideally, the cartons are formed from cardboard and the hinged connections may be constituted by fold lines, score lines or skip/score lines.

According to a second aspect of the present invention, there is provided a blank for producing a carton for receiving a plurality of articles, which blank provides panels for constituting a top portion, two side portions and a bottom portion, which panels are hingedly connected together, said blank providing at least one gusset portion between a side portion and the top portion at each of end thereof, each gusset portion being constituted by two panels, the first of which is hingedly connected to the associated side portion and the second of which is hingedly connected to the top portion, both panels of the gusset portion being hingedly connected together.

A more complete understanding of the present invention will be had by those skilled in the art, as well as an appreciation of additional advantages, which will become apparent upon reading the detailed description of the preferred embodiment and examining the drawings, the following of which is a brief description.

BRIEF DESCRIPTION OF THE DRAWINGS

Embodiments of the invention will now be described in more detail. The description makes reference to the accompanying diagrammatic drawings in which.

DETAILED DESCRIPTION

Figure 1:
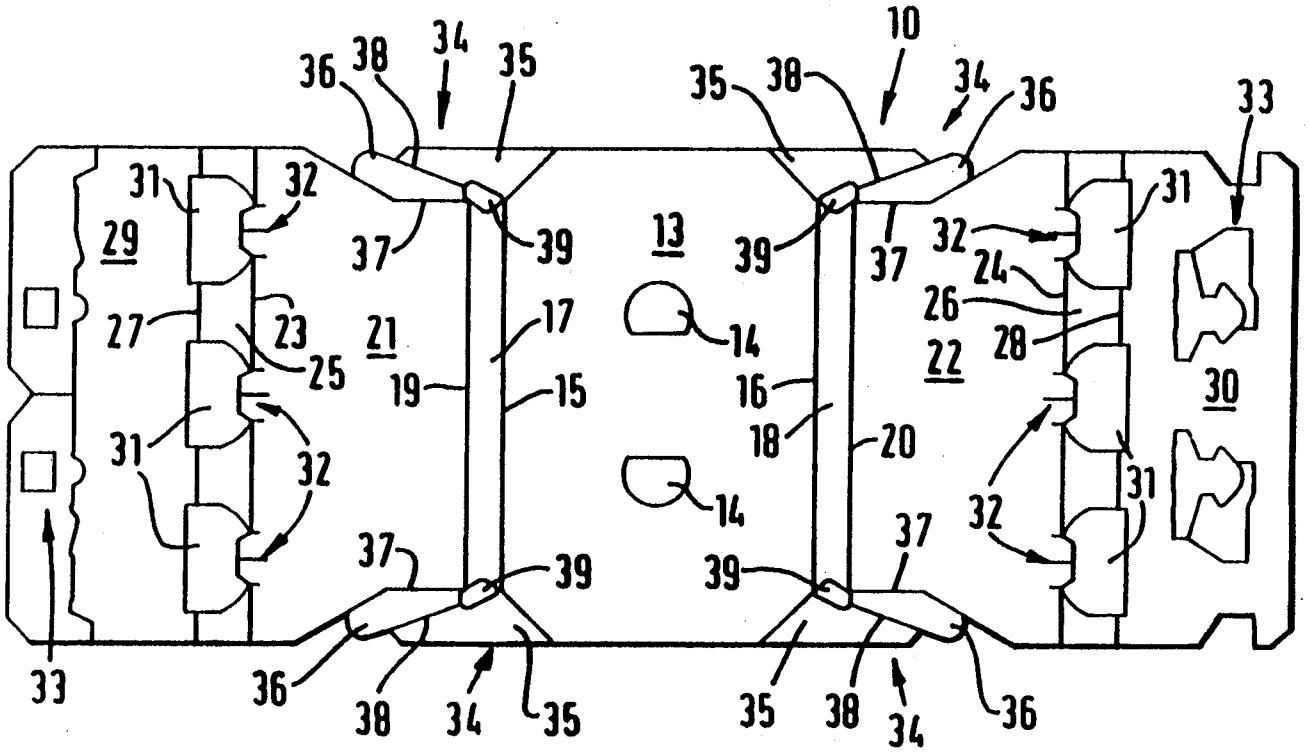
FIG. 1 shows a blank according to the present invention.
Figure 2:
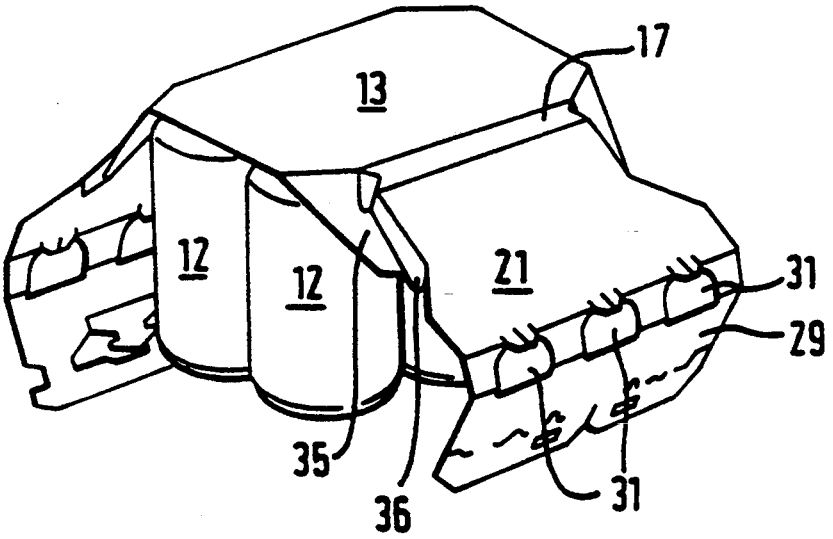
FIG. 2 is a perspective view of the blank of FIG. 1 being assembled into a carton.
Figure 3:
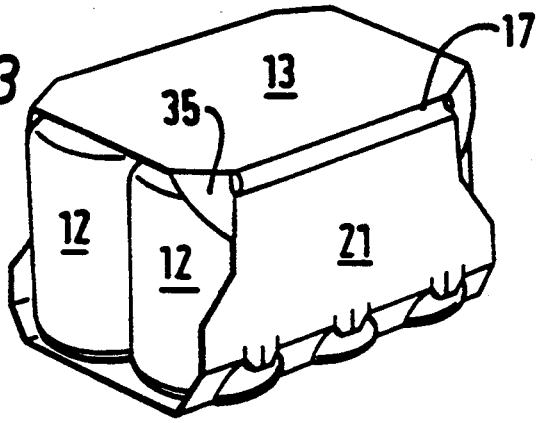
FIG. 3 is a perspective view of a carton according to the present invention made from the blank shown in FIG. 1.
Figure 4:
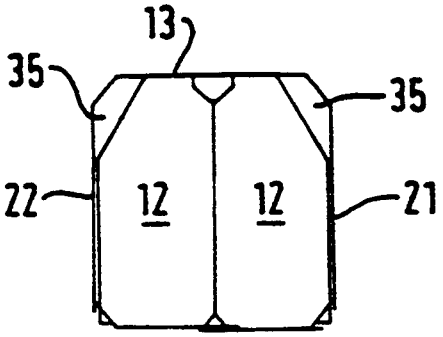
FIG. 4 is an end view of the carton shown in FIG. 3.

FIG. 1 shows a blank 10 for forming a carton 11, as shown in FIGS. 2 to 4, around a plurality of articles which in this case is six cans 12 for beverages arranged in two rows of three. The carton 11 has a top portion 13 formed with two finger holes 14 for facilitating the carrying of the carton. Hingedly connected to each side edge of the top portion along fold lines 15, 16 are upper side panels 17, 18 which are adapted to conform to the bevelled upper surfaces of the cans 12. Hingedly connected to each side of the upper side panels 17, 18 along fold lines 19, 20 are main side panels 21, 22. Hingedly connected to the lower edges of the side panels 21, 22 along fold lines 23, 24 are lower side panels 25, 26 which in turn are connected along fold lines 27, 28 to bottom panels 29, 20. with apertures 31 and formations 32 for engaging and retaining heel portions of the cans 12. As can be seen in FIG. 4, the heel of the can protrudes to some extent through the aperture 31 and this serves to prevent to a great extent transverse movement of the can 12 within the carton 11.

The bottom panels 29, 30 are provided with various formations 33 which are arranged so as to interlock and interengage so as to close the blank 10 to form the sleeve-like carton 11.

The blank 10 is also formed with gusset portions 34 which interconnect each side panel 21, 22 with the top portion 13. Each gusset portion 34 has a first panel 35 hingedly connected to the top portion 13 and a second panel 36 hingedly connected to the side panel 21, 22 along the fold line 37. The first and second panels 35, 36 are also hingedly connected together along fold line 38.

The upper side panel 17, 18 is bypassed by the provision of a hole 39.

When forming the carton 11 around the cans 12, the top portion is placed across the tops of the cans and the side panels and bottom panels are folded around the cans 12. During the folding the second panels 36 of the gusset portions 34 are tucked in behind their associated side panels 21, 22 and the bottom panels 29, 30 are connected together. These second panels 36 and the lower part of the first portions 35 are, in the finished carton 11, sandwiched in position between the cans 12 and the side panels 21, 22 and cannot readily be pulled out. In the finished carton 11 the first panels 35 of the gusset portions 34 partially block the open end areas of the carton and thereby prevent the tops of the cans from being removed from the carton. This is clearly shown in FIG. 4.

It will be appreciated that articles other than beverage cans can be used in the above described carton. For example, the carton could be adapted for use with bottles. Also different types of can would require sightly modified panel arrangements. For example, if the cans do not have an upper bevelled surface then the upper side panels 17, 18 may be omitted to leave the main side panels 21, 22 hingedly connected directly to the top portion 13. In addition it will be appreciated that other bottom panel securing techniques are envisaged, for example different formations 33 may be used or the two panels may simply be secured with adhesive. Also the connection between the ends of the blank has been shown as being in the bottom portion, but it will be appreciated that it could be located in a side or the top portion if required. Further modifications may include further fold lines in the first gusset portion if desired or in any other panel so as to accommodate features of the articles being contained.

The carton is ideally suited to manufacture from paperboard but other semi-rigid or rigid sheets could be used. Also fold lines could also encompass score lines or any combination of fold lines and score lines.

The above described type of carton provides a secure package for a plurality of articles and does not rely on apertures for retaining the tops of the articles. The weak spots between the endmost top apertures and the end edge of known cartons are therefore eliminated without adding bulk to the carton.

While a preferred embodiment of the invention has been disclosed in the foregoing specification and drawings, it will be understood by those skilled in the art that variations and modifications thereof can be made without departing from the spirit and scope of the invention, as set forth in the following claims.

I claim:

1. A carton for containing a plurality of cylindrical beverage cans with each can having a heel portion, said carton having two open ends defining a generally open-ended sleeve shape of said carton, said carton comprising:

a top panel having opposed side edges and opposed end edges;

spaced side panels each having a top edge, a bottom edge, and opposed end edges;

an upper side panel joining the top edge of each of said side panels to a corresponding side edge of said top panel, said upper side panels, said side panels, and said top panel defining two upper corner portions at each of the open ends of said carton;

a bottom panel joining and extending between said bottom edges of said side panels;

four independent gussets, each gusset extending between an end edge of one of said side panels and a corresponding end edge of said top panel, each gusset spanning a corresponding upper corner portion of an open end of said carton;

each gusset being hingedly attached to an end edge of said side panel, hingedly attached to a corresponding end edge of said top panel, and separate from the adjacent upper side panel;

each gusset having a single fold line intermediate its hinged attachments to the side and top panels, said fold line subdividing said gusset into a first portion attached to the top panel and a second portion attached to the side panel;

each gusset being folded along its fold line to position the second portion of the gusset against its corresponding side panel with the first portion of said gusset extending across at upper corner portion at an open end at said carton for retaining articles in said carton; and cut out sections formed in the bottom and side panels for receiving and retaining the heel portions of beverage cans grouped in the carton.

2. The carton of claim 1 and wherein said bottom panel is formed by a first bottom panel section extending from the bottom edge of one of said side panels and a second bottom panel section extending from the bottom edge of the other one of said side panels, said first and second bottom panel sections being joined together to form said bottom panel.

3. The carton of claim 1 and wherein said second portion of each gusset is sized and configured such that, when folded against its corresponding panel, it becomes sandwiched between said side panel and a beverage can contained in said carton whereby the beverage can holds the gusset in place with its second portion extending across an upper corner portion of an open end of said carton to retain the can beverage in the carton.

* * * * *